United States Patent [19]

Brown

[11] Patent Number: 5,020,438

[45] Date of Patent: Jun. 4, 1991

[54] BLADED PROJECTILE

[76] Inventor: Jim W. Brown, Rte. 1, Box 182, Kinston, Ala. 36453

[21] Appl. No.: 419,324

[22] Filed: Oct. 10, 1989

[51] Int. Cl.[5] ..... F42B 12/00

[52] U.S. Cl. ..... 102/517; 102/436; 102/439; 102/501; 273/58 K; 273/428

[58] Field of Search ..... 102/436, 439, 501, 502, 102/517, 519; 273/58 K, 428

[56] References Cited

U.S. PATENT DOCUMENTS

| | | | |
|---|---|---|---|
| 269,101 | 12/1882 | Palliser | 102/517 |
| 1,063,905 | 6/1913 | Beckmann | 102/501 |
| 1,169,704 | 1/1916 | Wesner | 102/519 |
| 1,218,546 | 3/1917 | Gillis | 102/501 |
| 1,777,519 | 10/1930 | Flowers | 102/436 |
| 4,644,866 | 2/1987 | Sullivan | 102/439 |
| 4,686,905 | 8/1987 | Szabo | 102/444 |
| 4,932,306 | 6/1990 | Rom | 102/501 |

FOREIGN PATENT DOCUMENTS

| | | | |
|---|---|---|---|
| 116184 | 12/1942 | Australia | 102/522 |
| 8516 | 8/1908 | United Kingdom | 102/501 |

*Primary Examiner*—Harold J. Tudor

*Attorney, Agent, or Firm*—Richard C. Litman

[57] ABSTRACT

A projectile includes a body having one of a number of geometric shapes which have a plurality of blades. The projectile may be divisible into two substantially equal portions. The portions have a number of blades disposed across their respective surfaces. Moreover, a blade may encircle the periphery of the projectile and may be sandwiched between the portions once assembled to one another. In one embodiment, the blades may be removed so that they may be replaced when they become dulled through use. Alternatively, the blades may be removed, sharpened, and returned to their appropriate positions on the projectile body.

14 Claims, 2 Drawing Sheets

FIG. 2
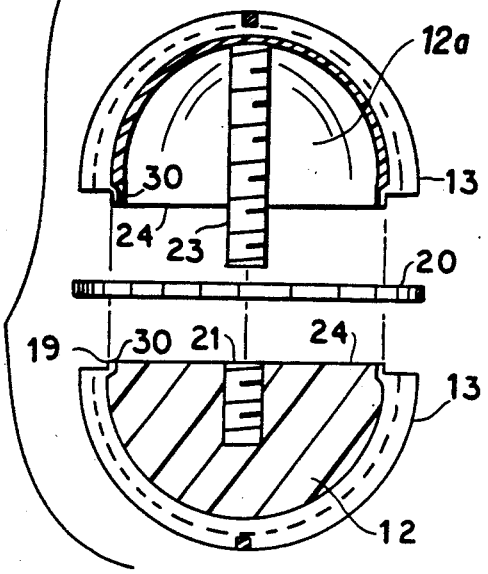
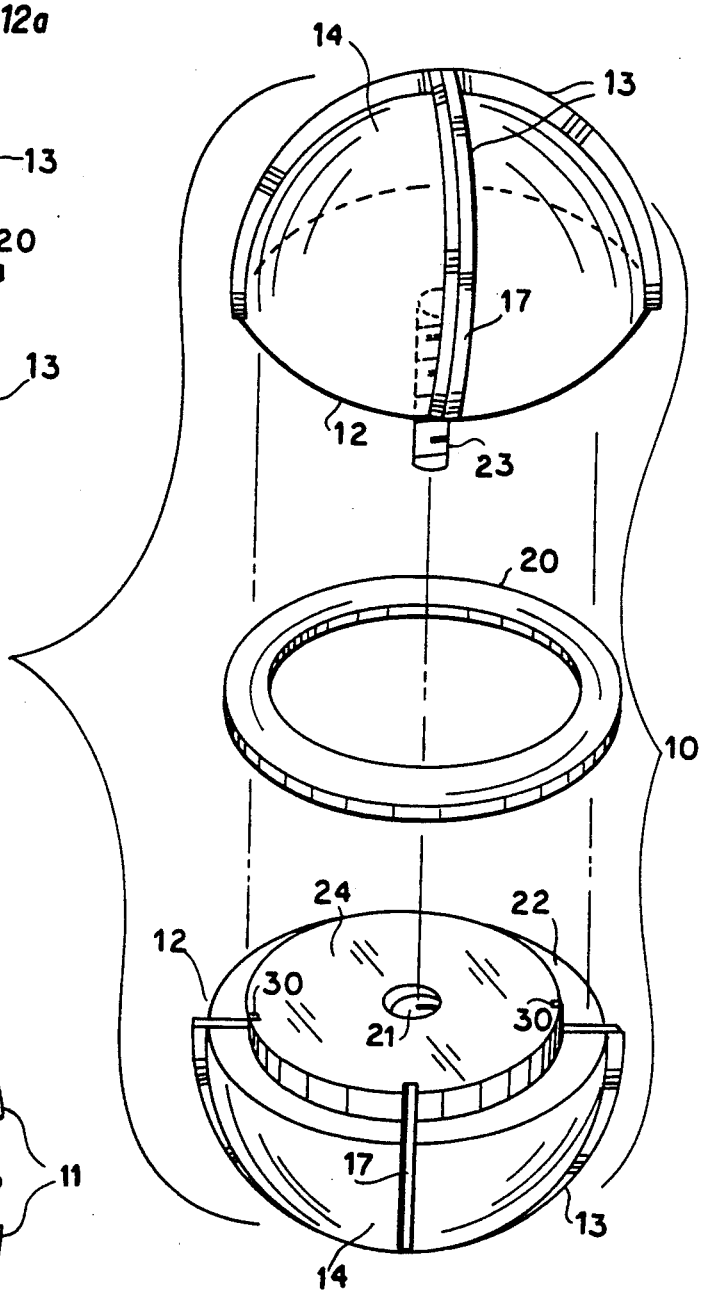
FIG. 1
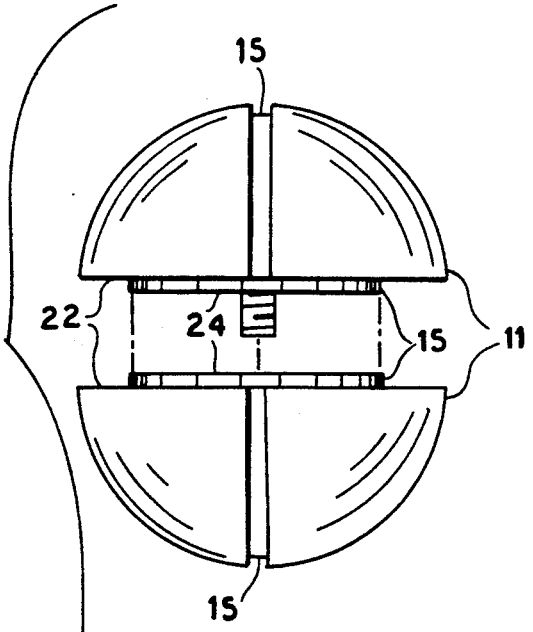
FIG. 3

BLADED PROJECTILE

BACKGROUND OF THE INVENTION

1. Field of the Invention

The present invention relates to projectiles. More specifically, the present invention relates to the construction of bladed projectiles, particularly a spherical projectile having a plurality of blades disposed thereabout. The present invention incorporates a means to attach blades to the surface of the spherical projectile to increase the injurious capacity of the projectile. Moreover, the blades may be removed and replaced when they have become dulled through use. Alternatively, the projectile may be constructed of a single piece of material, with the blades formed integrally with the remainder of the projectile.

2, Description of the Prior Art

Due to the novel construction of the present invention, there is little, if any, prior art which relates to the invention as described and claimed. However, there are a number of spherical projectiles disclosed by the prior art.

U.S. Pat. No. 2,033,105 issued to E. Cowles on Mar. 3, 1936 discloses a spherical projectile for a toy. Cowless teaches a construction of a spherical projectile having an opening wherein a paper cap may be placed for explosive detonation. The cap provides the noise-making capability of the apparatus. The Cowles disclosure describes a substantially spherical object which is attached to a string for throwing. The ball has a hollow section therein wherein a hammer is disposed. The hammer is forced onto the paper cap when the ball is dropped, thereby providing the explosive noise desirable for a child's toy. The present invention is not a toy. Nor is it designed specifically for harmless amusement.

U.S. Pat. No. 2,784,711 issued to K. E. Vaughn on Mar. 12, 1957 discloses a mechanical gun and projectile for the training of dogs. The gun is substantially a rifle in appearance. The gun incorporates a spring through its barrel for the forceful projection of a substantially spherical projectile. The projectile is ball-shaped with a hollow center portion for mounting on the rigle barrel. The surface of the projectile is studded with a plurality of spike-like protrusions. The gun fires the projectile and simultaneously produces a loud noise simulative of a gun being fired. The projectile is designed so that a dog may be trained to retrieve hunted game birds. The spikes on the projectile are included to train the dog not to chew on the fowl retrieved. Due to the unique nature of the present invention as it relates to the hunting and killing of animals, the Vaughn invention does not particularly apply.

U.S. Pat. No. 3,749,016 issued to J. Hershkowitz of Jul. 31, 1973 discloses a spherical projectile comprised substantially of a resilient material embedded with metallic particles. The projectile is designed so that it may be fired from a flattened state. Upon exiting the firing apparatus, the flattened sphere resumes its spherical shape. The Hershkowitz invention is designed specifically to be fired at a high velocity at objects in space. The projectile is intended to destroy selected targets such as satellites. The construction of this invention is specifically focused upon the compressible character of the projectile. As the present invention is not compressible, it does not provide a preclusive effect on the present invention.

U.S. Pat. No. 3,791,303 issued to P. E. Sweeney on Feb. 12, 1974 discloses a spherical projectile which may be used as a personnel deterrent in situations such as riots. The spherical projectile incorporates a series of indentations cut into its surface to facilitate rupture on impact with a human target. The projectile may be filled with liquid to increase its detterent effect. The projectile is designed specifically not to injure the target at which it is fired. As a result, it differs from the present invention which is designed specifically for an injurious effect.

The present invention incorporates a plurality of blades disposed on the surface of a spherical body. The bades are interlocked so that they are not dislodged upon impact with a substantially solid target. The blades are also designed so that they may be removed and replaced should they become dulled throug use. Alternatively, the blades and projectile may be formed as a single monolithic unit. The present invention offers a unique and novel approach to the construction of projectiles specifically designed for the hunting of game and other wild animals.

SUMMARY OF THE INVENTION

Accordingly, it is an object of the present invention to provide a projectile having a substantially spherical shape.

It is still another object of the present invention to provide a spherical projectile having a plurality of blades disposed about its surface.

It is yet another object of the present invention to provide a means to attach the blades to the surface of the projectile in such a manner so that they are not easily displaced upon impact with a substantially solid target.

It is yet another object of the present invention to provide a projectile that is light in weight so that is is not cumbersome to use.

It is still another object of the present invention to provide a projectile that is easy to manufacture.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

FIG. 1 is an exploded perspective illustration of the primary embodiment of the present invention.

FIG. 2 is a cross-sectional illustration of the embodiment presented in FIG. 1.

FIG. 3 is a side view illustration of the body halves of the embodiment shown in FIG. 1.

Similar reference characters designate corresponding parts throughout the various figures of the drawings.

DESCRIPTION OF THE PREFERRED EMBODIMENT

Figure 4:
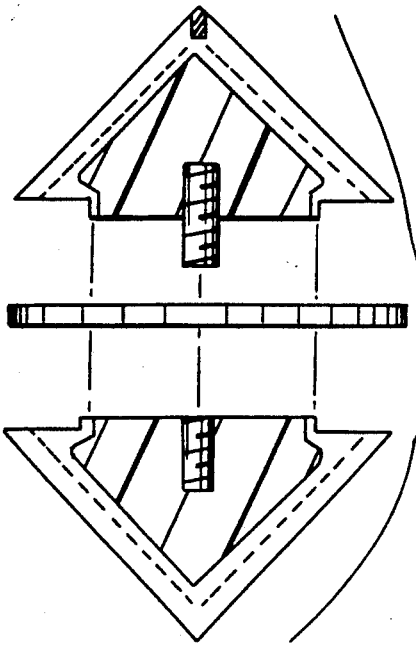
FIG. 4 is a cross-sectional illustration of an example of one of the alternate embodiments of the present invention.
Figure 5:
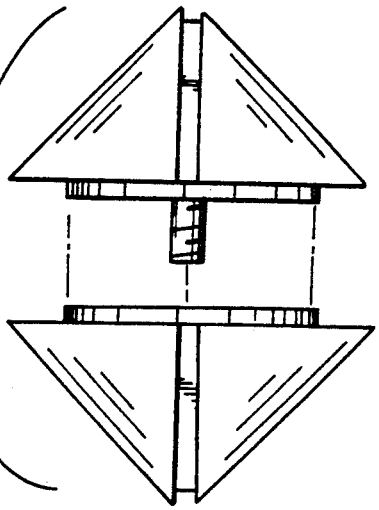
FIG. 5 is a side view illustration of the embodiment shown in FIG. 4.

The present invention is generally designated 10 in FIG. 1. It important to state at this early point in the present discussion that the projectile 10 may be formed in any number of possible geometries. Primarily, the present invention is embodied by the spherical projectile 10. However, the shape of the projectile can be varied without deviating from the scope of the present invention. As a result, an example of an alternate embodiment is provided through FIG. 4 and FIG. 5 wherein the body has a polygonal cross section. This embodiment is provided as an example of one of the infinite number of possible geometries that are offered by the apparatus of the present invention.

Figure 6:
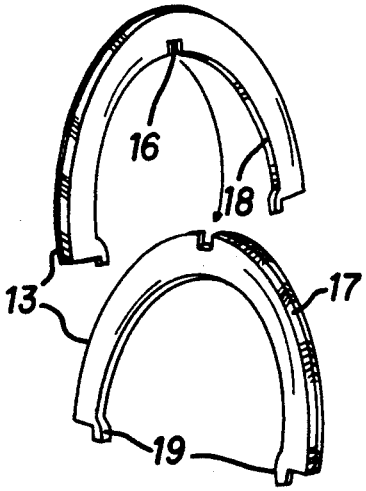
FIG. 6 is a perspective illustration of the interlocking assembly of the blades. The solid body is omitted for clarity of the drawings.

The projectile 10 of the present invention is composed of a solid body 11 having two hemispherical portions 12. Disposed across its surface are a plurality of blades 13. The blades 13 may be rectangular in cross-section as shown in FIG. 1, or they may be sharpened to offer a cutting edge. The cutting edge is disposed on the outer surface 17 of the blade 13 as shown in FIG. 6. In order to facilitate understanding of the present invention, the embodiment shown in FIGS. 1 through 3 will be described herein. However, anyone skilled in the art should have no difficulty applying the apparatus of the present invention to any suitable geometric shape.

FIG. 1 displays the projectile 10 of the present invention having a spherical three dimensional shape. The solid body 11 is divided into two hemispherical portions 12 as mentioned. The curved portion of the surface 14 of the solid body 11 is provided with a number of grooves 15 disposed longitudinally there across, more clearly shown in FIG. 3. It is possible, however, that grooves 15 could be added to encircle the hermispherical portions 12 in a latitudinal fashion.

The grooves 15 are substantially rectangular indentations into the surface of the projectile 10. The blades 13, also having rectangular cross-sections at their base portions, are designed so that they fit easily into the groove 15. The blades 13 are semicircular shaped wedges of metal or other suitable substance. They incorporate at least one notch 16 on either their outer surface 17 or their inner surface 18 depending upon the design of the assembly, as shown in FIG. 6. They also include extrusions 19 on the inner surface which are designed to grip the solid body 11 to prevent the dislodgement of the blades 13 from the projectile 10.

A blade encircles the equatorial perimeter of the projectile 10 shown in FIG. 1. The equatorial blade 20 differs from the rest in that it has the shape of the equator of the projectile 10. The equatorial blade 20 takes the shape of the cross-section of the projectile 10. In this present example, the equatorial blade 20 is a ring shaped circle.

The hemispherical portions 12 include threaded holes 21 in their center portions on their flattened sides 22. One of the hemispherical portions 12 will have a screw 23 threaded into the threaded hole 21. The other hemispherical portion 12 will not. Thus, the hemispherical portions 12 can be attached to one another by threading the screw 23 from the one hemispherical portion 12 into the threaded hole 21 of the other hemispherical portion 12.

Alternatively, in order to allow a lighter weight projectile the interior of each hemisphere may be hollowed as shown in the upper hemisphere **12*a* of FIG. 2. Preferably, both hemispheres 12*a* of a given projectile 10 would be hollowed if a lighter projectile 10 is desired, in order to preserve the balance of the projectile 10. In this case screw 23 may be secured to the interior shell of one hemisphere 12*a* and a protrusion containing a mating threaded hole 21 may be left in the hollowed interior of the opposite hemisphere 12. Male and female threads, not shown, may also be formed in the periphery of mating hollowed hemispheres 12*a*, thus eliminating the need for central threaded components 21 and 23**.

The hemispherical portions 12 have a raised area 24 on their flattened sides 22. This raised area 24 is essential to the construction of the projectile 12 if an equatorial blade 20 is desired. When the hemispherical portions 12 are threadedly joined, the raised areas 24 will meet. Since the raised areas 24 are of a lesser diameter than the hemispherical portions 12, the raised areas 24 will create a groove 15 at the equator of the projectile 10. Thus, the equatorial blade 20 may be sandwiched between the hemispherical portions 12 within the groove 15 at the equator defined by the raised areas 24. An equatorial blade 20 may be omitted if desired.

At the apex of each of the blades 13, there is included a notch 16 either on the inner surface 18 or the outer surface 17. The location of the notch 16 depends upon the location of the blade 13 and the arrangement of the blade construction. In FIG. 1, two blades 13 are shown extending longitudially across the hemispherical portion 12. Thus, the blades 13 substantially divide the hemisphere into four quarter hemisphere portions. For the first blade 13 placed on the hemisphere surface, the notch 16 will appear on the outer surface 17. The second blade 13 will be placed over the first. As such, to obtain an interlocking design, the second blade 13 will have the notch on the inner surface 18. The notch 16 of each of the blades 13 will fit into one another so that the blades form essentially a uniform structure.

Figure 7:
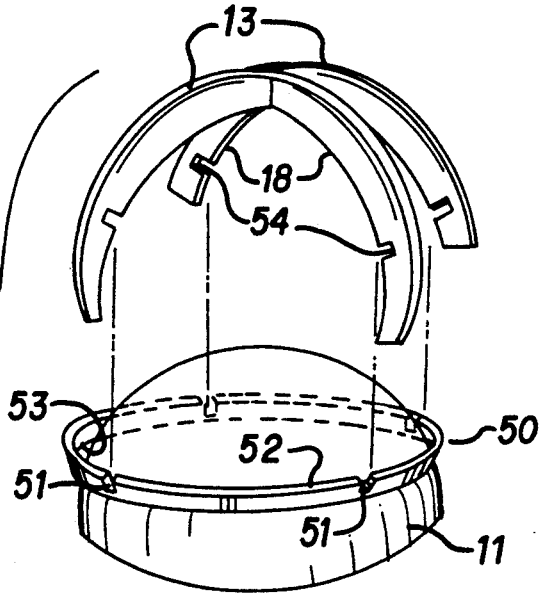
FIG. 7 is a perspective illustration of an alternate embodiment of the blade arrangement showing the addition of a latitudinal blade between the equator and the apex of one of the hemispherical portions of the projectile.

If a latitudinal blade construction is desired, the arrangement is somewhat different. In this case, the latitudinal blade 50 will have angular notches 51 across its outer surface 52. The inner surface 53 will be smooth and continuous. The latitudinal blade 50 will be similar to the longitudinal blades 13, but formed in a diamter appropriate to the latitude of the body 11 at which they are installed. They will insert into the solid body 11 at a defined latitudinal position. The blades 13 will fit over the latitudinal blade 50. The angular notches 51 on the outer surface 52 of the latitudinal blade 50 will fit into angular notches 54 on the inner surface 18 of the longitudinal blades 13. FIG. 7 shows this construction.

The blades 13 contain rectangular protrusions 30 extending from the extrusions 19. These protrusions 30 fit into a space provided at the periphery of the raised area 24. The protrusions 30 provide additional structural support for the equatorial blade 20. If an equatorial blade 20 is not added to the projectile 10, then the protrusions 30 may be omitted, because their support for the equatorial blade 20 is not needed.

Figure 8:
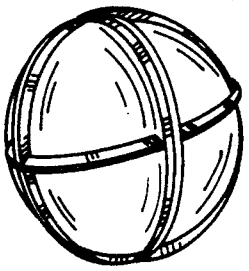
FIG. 8 is a perspective illustration of the projectile and blades formed as a single monolithic unit or as they would appear in their assembled state.
Figure 9:
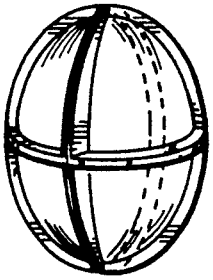
FIG. 9 is a side view of a further embodiment of the invention.

The intent of the above described method of construction and assembly of projectile 10 is to allow the various components comprising projectile 10 to be easily replaced if damaged or lost, and then easily reassembled. Blades 13, 20 and/or 50 may also be easily removed for sharpening and then easily replaced with this method. However, in some cases it may be desirable to form projectile 10 as a single monolithic unit as shown in FIG. 8. Such a bladed projectile could be formed in any of the shapes shown in FIGS. 1 through 9, as well as an infinite variety of other shapes. In FIG. 9, the projectile has a substantially ellipsoidal cross section. Externally the projectile of FIG. 8 would appear identical to those shown in various disassembled states in FIGS. 1 and 2. It would also be possibly by means of centrifugal casting or other methods to form such a monolithic projectile containing a hollow center, thus providing for a lighter weight projectile.

It is to be understood that the present invention is not limited to the sole embodiment decribed above, but encompasses any and all embodiments within the scope of the following claims.

I claim:

1. A projectile comprising:

a three dimensional body having an exterior surface, said body comprised of two substantially equal portions, said portions removably engageable with one another by an attachment means, a plurality of grooves disposed across said exterior surface of said body, a corresponding number of removable blades cooperating with and closely fitting within said grooves, each of said blades projecting radially from the center of said body, each of said blades extending continually around the exterior surface of said body, said blades having attachement means between said blades and said body portions, whereby said blade attachement means maintains said blades within said grooves.

2. A projectile according to claim 1 wherein;

said portions of said projectile body are hollow.

3. A projectile according to claim 1 wherein;

said body portion attachment means comprises centrally located cooperating threaded fittings.

4. A projectile according to claim 1 wherein;

said blades each having an interior surface and an exterior surface, said blade attachment means being extrusions disposed upon said interior surface whereby said extrusions project into and closely cooperate with said body thus preventing inadvertant detachment of said blades.

5. A projectile according to claim 1 wherein;

said body comprises a substantially circular cross section.

6. A projectile according to claim 1 wherein;

said body comprises a substantially polygonal cross section.

7. A projectile according to claim 1 wherein;

said body comprises a substantially ellipsoidal cross section.

8. A projectile according to claim 2 wherein;

said body comprises a substantially circular cross section.

9. A projectile according to claim 1 wherein;

said body comprises a substantially polygonal cross section.

10. A projectile according to claim 2 wherein;

said body comprises a substantially ellipsoidal cross section.

11. A projectile according to claim 1 wherein;

said blades each having an exterior surface, and said blade exterior surfaces form cutting edges.

12. A projectile according to claim 2 wherein;

said blades each having an exterior surface, and said blade exterior surfaces form cutting edges.

13. A projectile according to claim 1 wherein;

said body portions are separable at the equatorial perimeter of said body, said body equatorial perimeter contains a circumferential groove, said circumferential groove providing means for the containment of a circumferential blade when said body portions are engaged with one another.

14. A projectile according to claim 2 wherein;

said body portions are separable at the equatorial perimeter of said body, said body equatorial perimeter contains a circumferential groove, said circumferential groove providing means for the containment of a circumferential blade when said body portions are engaged with one another.

* * * * *